US007517031B2

(12) United States Patent
Laible

(10) Patent No.: US 7,517,031 B2
(45) Date of Patent: Apr. 14, 2009

(54) BODY FOR A REFRIGERATOR

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 887 days.

(21) Appl. No.: 10/725,090

(22) Filed: Dec. 1, 2003

(65) Prior Publication Data

US 2004/0108798 A1 Jun. 10, 2004

Related U.S. Application Data

(63) Continuation of application No. PCT/EP02/05803, filed on May 27, 2002.

(30) Foreign Application Priority Data

Jun. 1, 2001 (DE) ..... 101 26 843.2

(51) Int. Cl.
*A47B 96/04* (2006.01)

(52) U.S. Cl. ..... 312/406.2; 312/406; 312/405; 312/401

(58) Field of Classification Search ..... 312/263, 312/265.5, 401, 406–406.2, 407, 405; 62/440, 62/441

See application file for complete search history.

(56) References Cited

U.S. PATENT DOCUMENTS

| | | | | | |
|---|---|---|---|---|---|
| 3,984,223 | A | * | 10/1976 | Whistler, Jr. | 62/441 |
| 4,170,391 | A | * | 10/1979 | Bottger | 312/405 |
| 4,301,663 | A | | 11/1981 | Hoshino | |
| 4,550,576 | A | * | 11/1985 | Tate et al. | 62/441 |
| 4,586,348 | A | | 5/1986 | Nakayama et al. | |
| 4,606,112 | A | * | 8/1986 | Jenkins et al. | 312/406.2 |
| 4,706,363 | A | * | 11/1987 | Taylor, Jr. | 312/406.2 |
| 4,870,735 | A | * | 10/1989 | Jahr et al. | 29/890.035 |
| 4,955,676 | A | * | 9/1990 | Weaver et al. | 312/407 |
| 4,958,890 | A | | 9/1990 | Anderson et al. | |
| 5,899,546 | A | * | 5/1999 | Avendano et al. | 312/406.2 |
| 6,036,293 | A | * | 3/2000 | Anell et al. | 312/406 |

FOREIGN PATENT DOCUMENTS

| | | | |
|---|---|---|---|
| DE | 197 56 858 | A1 | 6/1999 |
| EP | 0 127 013 | A2 | 12/1984 |
| FR | 1.362.178 | | 6/1963 |
| GB | 2 149 488 | A | 6/1985 |
| GB | 2 191 852 | A | 12/1987 |
| JP | 11094448 | * | 4/1999 |
| JP | 2000266458 | * | 9/2000 |
| JP | 2000337760 | * | 12/2000 |

* cited by examiner

*Primary Examiner*—Hanh V Tran
(74) *Attorney, Agent, or Firm*—Russell W. Warnock; James E. Howard

(57) ABSTRACT

A body for a refrigerator device, includes a front side that is open towards the interior of the body, whereby the opening on the front side is defined by vertical edge strips and horizontal front strips. At least one edge strip, together with a side wall, is a component of a side part formed from a slab of flat material. The side part has a clamp-type joint element that is joined to the front strip. The front strip, which is inserted into the joint element, exerts a force upon the edge strip, working towards an expansion of the angle at which the edge strip is connected to the side wall thereof.

11 Claims, 5 Drawing Sheets

Fig. 5
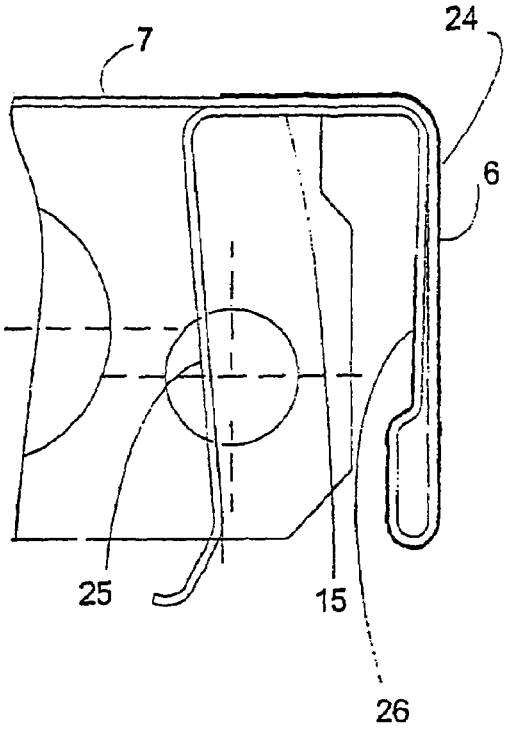
Fig. 6
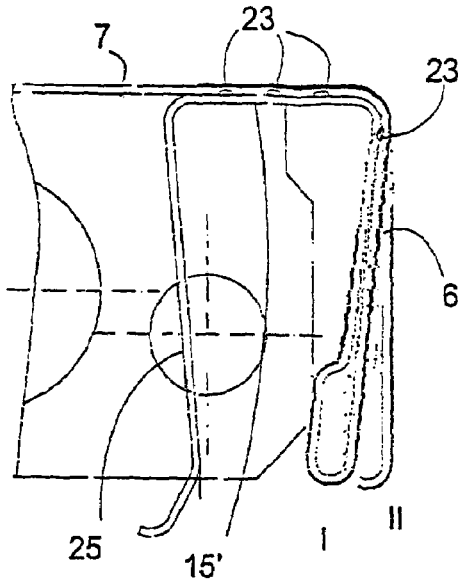
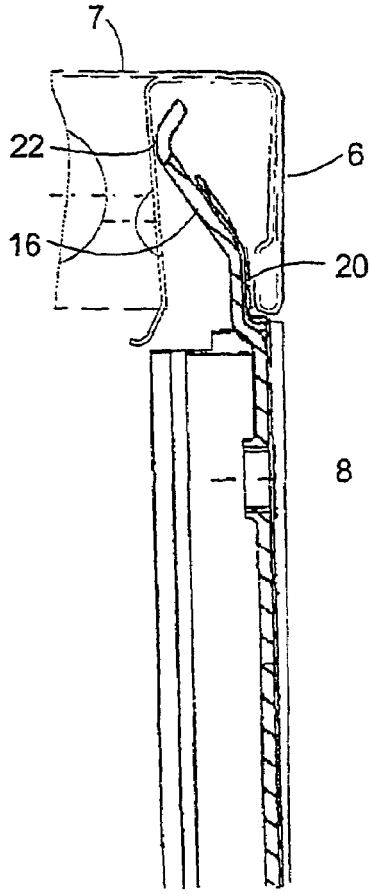
Fig. 7

BODY FOR A REFRIGERATOR

CROSS-REFERENCE TO RELATED APPLICATION

This application is a continuation of copending International Application No. PCT/EP02/05803, filed May 27, 2002, which designated the United States and was not published in English.

BACKGROUND OF THE INVENTION

FIELD OF THE INVENTION

Such a body or basic structure has a front side that is open in the direction of an interior, the front side being constructed substantially by vertical border strips and -horizontal end bars, which enclose the opening of the front side. The border strips of such a body are generally formed integrally with side walls of the body by bending metal sheets. On account of fluctuating metal-sheet hardnesses, it is difficult, when bending these metal sheets, to maintain an angle of precisely 90° between the part that forms the side wall and the part that forms the border strip.

As far as the costs and environmental protection are concerned, it is desirable for the metal sheets that are to form the side walls and border strips of the body to be provided with a color coating only wherever they are actually visible to a person using the built-in appliance. Large parts of the side walls that are no longer accessible or visible once the appliance has been installed in a kitchen, can remain free of color. Those surface regions of the metal sheets that are actually visible on the built-in appliance may be provided with color in a cost-effective manner by being coated with a sheet material. Such a sheet material, however, is more sensitive to pressure than a conventional layer of paint.

Hinges that are required for fitting a door to the body are usually screwed onto an end bar of the front side and project laterally beyond the border strip and the side wall. If the side wall and the border strip come into contact at a slightly acute angle rather than precisely at right angles, this results in a region of the hinge that projects laterally beyond the end bar pressing onto the border strip and leaving unsightly impressions in the adhesively bonded colored sheet material. If a change in the door fastening is necessary when the refrigerator is installed, then these impressions are visible wherever the hinges have been removed. This may be regarded by a user as a shortcoming of the refrigerator.

Although it would be conceivable to eliminate such a problem by increasing the requirements that have to be met by the precision of the right angle between the border strip and side wall, such a correction involves additional production outlay, which cancels out the savings that are possible as a result of limiting the color coating just to the visible region of the built-in appliance. Another possibility is to ensure that the surfaces of the end bar and the border strip are parallel by virtue of attaching the two with a number of screw connections. However, such a feature also involves additional production outlay, which may cause such a solution to appear uneconomic.

SUMMARY OF THE INVENTION

It is accordingly an object of the invention to provide a body for a refrigerator that overcomes the hereinafore-mentioned disadvantages of the heretofore-known devices of this general type and in which the occurrence of impressions on, or other surface damage to, a vertical border strip is avoided in a straightforward and cost-effective manner by a hinge that is mounted on an end bar and projects onto the border strip.

With the foregoing and other objects in view, there is provided, in accordance with the invention, a housing for a refrigerator, including a body defining an interior and having at least one side part formed from a panel of flat material, side walls, and a front side with an opening open to the interior, vertical border strips and horizontal end bars surrounding the opening, at least one of the border strip together with at least one of the side walls being a constituent part of at least one of the side parts, the side part having a joining element for joining the side part together with the end bar, and the end bar being introduced into the joining element and subjecting the border strip to a force having an effect of widening an angle at which the border strip is connected to the side wall.

In the case of the body, solely the act of joining the end bar and the border strip together results in the body being subjected to stressing that causes an angle between the border strip and side wall, which may be acute in the relaxed state, to widen.

In accordance with another feature of the invention, the joining element of the body according to the invention, preferably, forms a clamp that clamps in the end bar between two points of contact that are located on a front side and a rear side, respectively, of the end bar and are each spaced apart by different distances from a side wall of the body. Such a configuration of the points of contact allows the clamp to be subjected to a torque that has the effect of widening the angle.

In accordance with a further feature of the invention, the end bar has a joint-on buffer body forming at least one of the points of contact.

In accordance with an added feature of the invention, the point of contact on the rear side of the end bar is located closer to an adjacent one of the side walls than the point of contact on the front side of the end bar.

In accordance with an additional feature of the invention, the clamp may be configured as a U-profile, the distance between opposite legs of the U-profile being greater than the thickness of that section of the end bar that engages in the clamp, and the section extending obliquely through the groove of the U-profile between the two points of contact.

In accordance with yet another feature of the invention, the joining element is, preferably, connected integrally to an edge of the border strip that is directed away from the side wall. Such a configuration allows the side wall, the border strip, and the joining element to be produced in one operation from one piece of sheet metal or some other suitable flat material.

In accordance with yet a further feature of the invention, as a result of a first configuration, the joining element is connected elastically to the border strip. The elastic connection may be provided, in particular, at the free end of the border strip that is connected toward the opening of the front side.

Such a configuration, when the end bar and border strip are joined together, allows elastic deformation by which the joining element as a whole is rotated elastically in relation to a rest position, which it assumes when not joined together with the end bar.

A rigid connection between the joining element and the border strip or the side wall thereof is, likewise, possible.

In accordance with yet an added feature of the invention, the joining element is retained by the end bar in a position in which the joining element has been rotated elastically in relation to a position that the joining element assumes when not joined together with the end bar.

In accordance with yet an additional feature of the invention, the border strip is covered with a colored sheet material.

In accordance with a concomitant feature of the invention, the side wall is free of a color coating at least in a rear region thereof.

With the objects of the invention in view, in a refrigerator body defining an interior and having a front side with an opening open to the interior, vertical border strips and horizontal end bars surrounding the opening, at least one of the border strips, together with a side wall being a constituent part of a side part formed from a panel of flat material, there is also provided a connection configuration including a joining element at the side part for joining the side part together with the end bar, the end bar being introduced into the joining element and subjecting the border strip to a force having an effect of widening an angle at which the border strip is connected to the side wall.

Other features that are considered as characteristic for the invention are set forth in the appended claims.

Although the invention is illustrated and described herein as embodied in a body for a refrigerator, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 5 is a fragmentary, horizontal, cross-sectional view through a front border region of a side part of the body of the refrigerator of FIG. 1;

FIG. 6 is a fragmentary, horizontal, cross-sectional view through a second configuration of the front region of the side part of the body of the refrigerator of FIG. 1;

FIG. 7 is a fragmentary, cross-sectional view of the end bar according to the invention in engagement with the front region of the side part from FIG. 6.

DESCRIPTION OF THE PREFERRED EMBODIMENT

Figure 1:
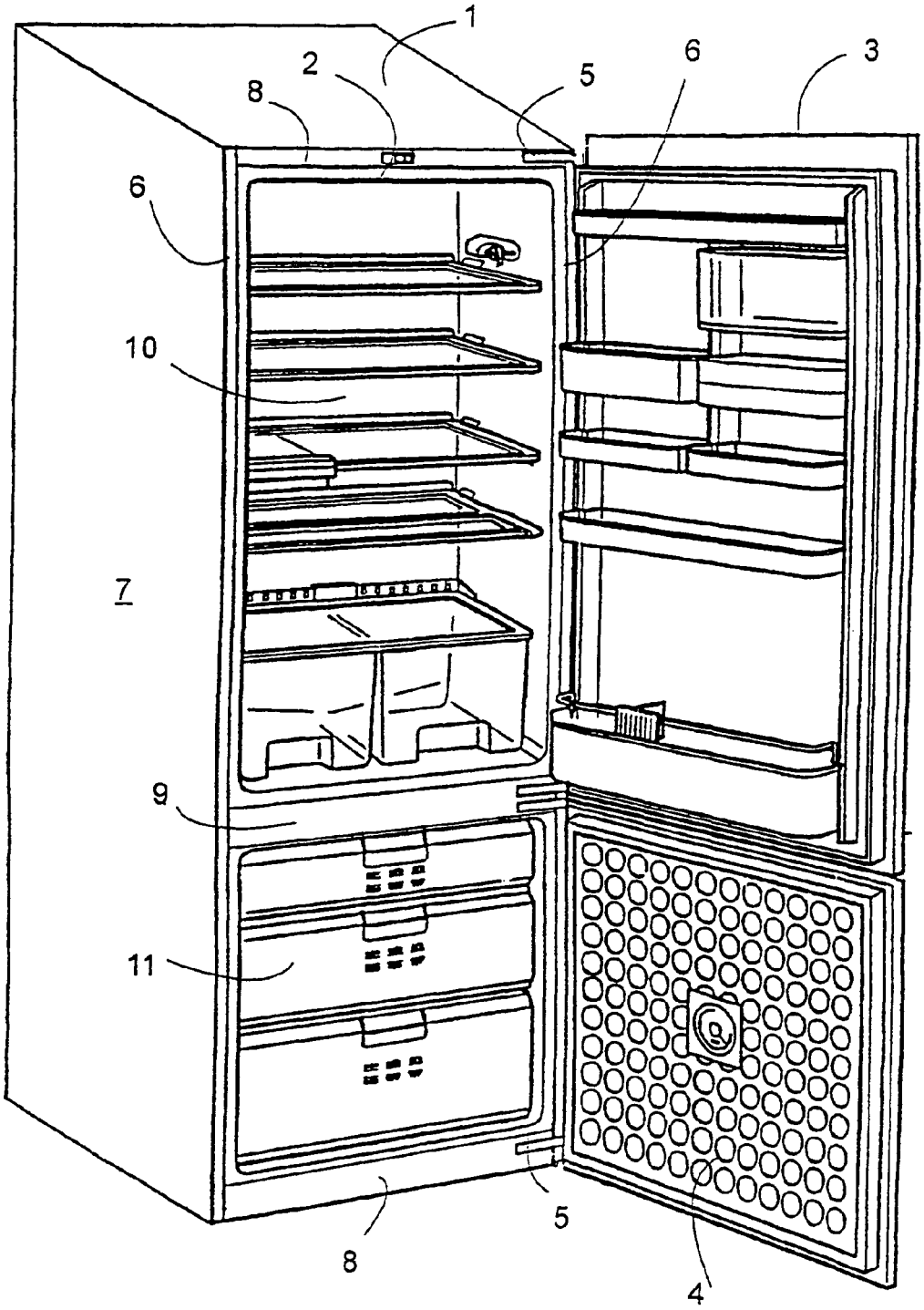
FIG. 1 is a perspective view of a built-in refrigerator with a body according to the invention.

Referring now to the figures of the drawings in detail and first, particularly to FIG. 1 thereof, there is shown a perspective view of a built-in refrigerator with a body 1 according to the invention, two doors 3, 4 being mounted on the front side 2 thereof with the aid of hinges 5. The front side 2 is made up of two border strips 6, which are each connected integrally to a side part by way of a side wall 7, and of end bars 8, 9 that surround openings 10, 11 of a refrigerating compartment and freezer compartment at the top and bottom.

Figure 2:
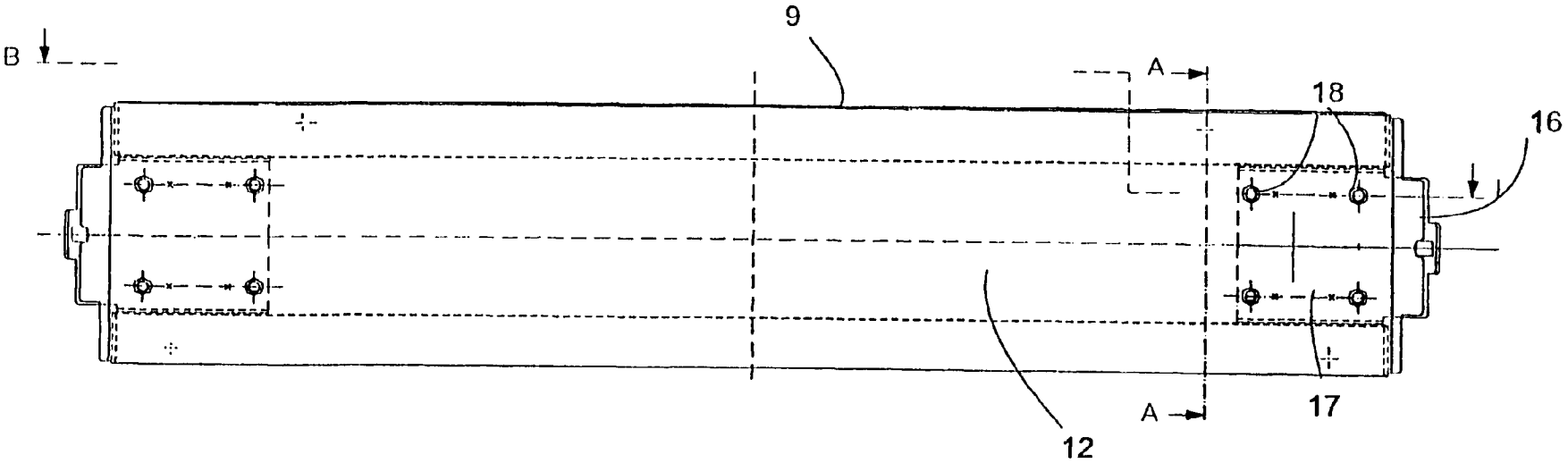
FIG. 2 is a plan view of an end bar that is part of the front side of the appliance of FIG. 1.
Figure 3:
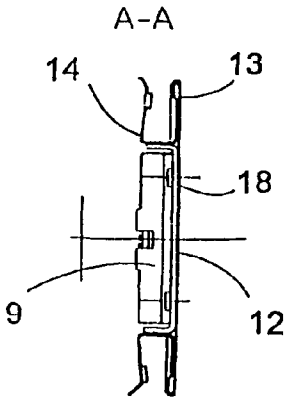
FIG. 3 is a cross-sectional view of the end bar of FIG. 2 along section line A-A.

The central end bar 9 is shown, in FIG. 2, in a plan view from the front side of the refrigerator and, in FIG. 3, in a section along line A-A in FIG. 2. The end bar 9 is constructed from a central piece 12 in the form of a sheet-metal profile, on which a bead 13 and an elastic clamp 14 of the substantially U-shaped cross-section are formed one after the other by virtue of the two longitudinal borders of the profile being bent over. The two clamps 14 each serve for clamping a non-illustrated border section of a thermoformed plastic part forming in each case the inner walls of the refrigerating compartment and of the freezer compartment of the refrigerator.

The two end bars 8 of FIG. 1 each have, along a border, a clamp in the manner of the clamps 14 for the same purpose.

A corresponding clamp 15 is also provided in each case on the border strips 6 of the side walls 7, as is shown in the section from FIG. 5. The clamps 15 perform a double function, namely, on one hand, of accommodating and retaining the borders of the plastic moldings that form the inner walls of the refrigerating compartment and freezer compartment and, on the other hand, of accommodating the end section 16 of two reinforcing plates 17 (see FIG. 2), which are each firmly mounted at-the ends of the central piece 12 of the end bars and have the threads 18 for screwing the hinges 5 tight.

A thick solid line in FIG. 5 illustrates the extent of a colored sheet material 24 that is adhesively bonded on the border strip 6 as a replacement for extensive paintwork. Starting from the front end region of the side wall 7, the material 24 extends over the border strip 6, the bead 13, and part of the length of a leg 26 of the clamp 15, the leg 26 adjoining the bead 13.

Figure 4:
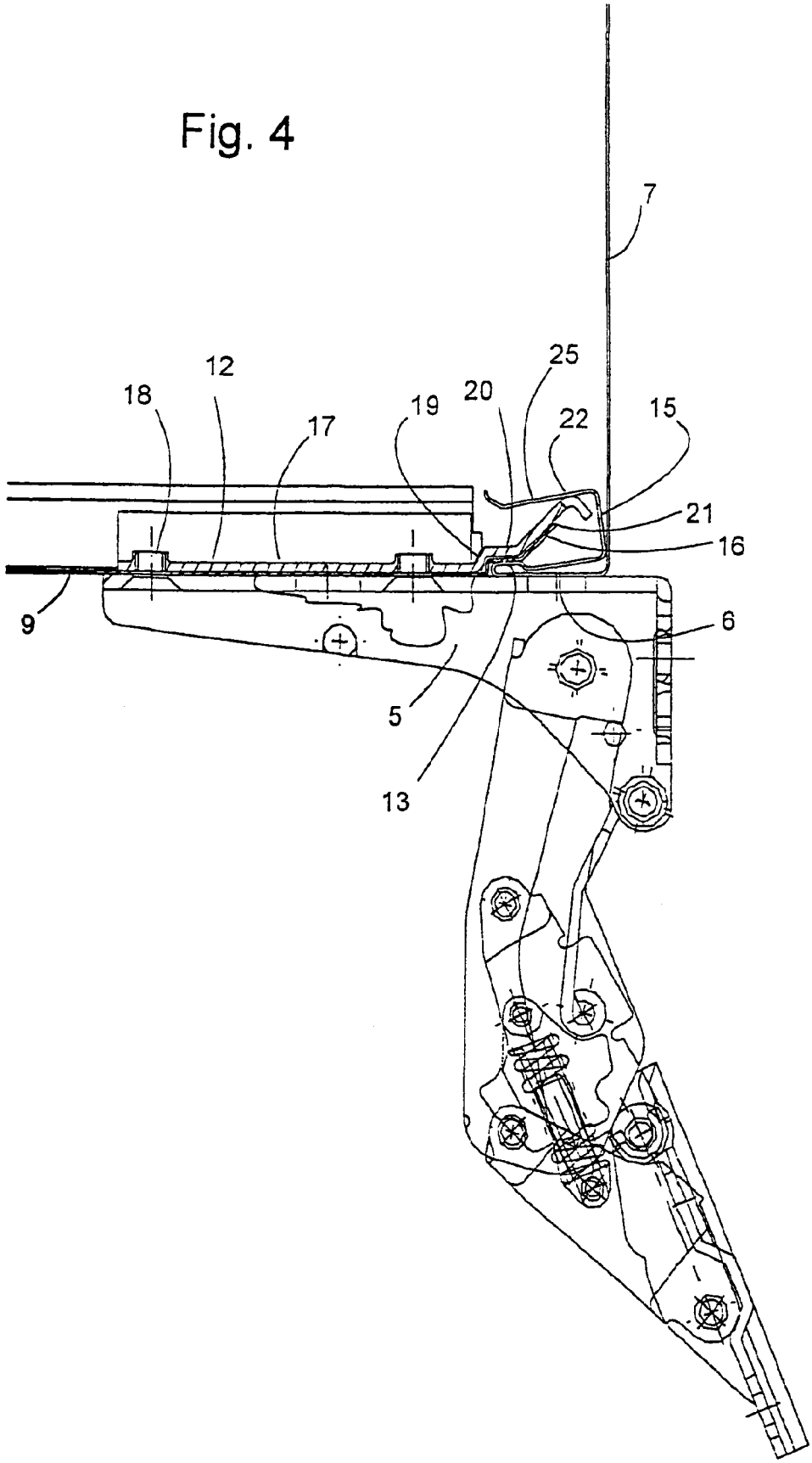
FIG. 4 is a fragmentary, horizontal cross-sectional view through a corner of the body of the refrigerator of FIG. 1.

FIG. 4 shows a horizontal section through an end region of the end bar 8 with the reinforcing plate 17, the end section 16 of which engages in the clamp 15 of a side part and on which a hinge 5 is mounted. Starting from the central piece 12, the end section 16 includes a step 19, a first point of contact 20 that is set back by the depth of the step, a diagonal section 21, and a second point of contact 22. The depth of the step 19 is dimensioned such that the border strip 6 adjoins the central piece 12 of the end strip 9 in a flush manner when the bead 13 thereof comes into contact with the first point of contact 20. The diagonal section 21 extends diagonally through the interior of the clamp 15, with the result that the second point of contact 22 presses against a leg 25 of the clamp 15., the leg 25 being directed away from the border strip 6, and, thus, retains the clamp in a position in which it has been rotated in the counterclockwise direction in relation to its rest state, which is shown in FIG. 5. Such rotation of the clamp 15 is transferred to the border strip 6 and, because the side wall 7 is not itself rotatable, results in a widening of the angle at which the side wall 7 and the border strip 6 come into contact with one another. Such widening reduces a pressure that otherwise, if the angle were slightly less than 90°, could occur between the hinge 5 and that region of the border strip 6 that is in the vicinity of the side wall 7, and result in damage to the surface of the border strip.

FIG. 6 shows a modified configuration of the front region of the side wall 7 and of the border strip 6. FIG. 6 shows the border strip 6, on one hand, in a position I, which it assumes in the relaxed state and in which it is in contact with the side wall 7 at an acute angle, and, on the other hand, in a position II, in which the angle between the side wall 7 and border strip 6 is precisely 90°. The clamp 15' has the same configuration as the clamp 15 in FIG. 5, although the clamp 15' is firmly connected to the border strip 6 or the side wall 7, e.g., by spot welding, at at least one point 23. It is, thus, not possible in such a configuration for the clamp 15' to be rotated in relation to the border strip 6.

FIG. 7 shows the front region of the side wall 7, which is shown in FIG. 6, the border strip 6, and the clamp 15' with the end bar 8 introduced into the clamp 15'. Because the distance between the second point of contact 22 and the side wall 7 is small, the leg 25 of the clamp 15', the leg 25 being in contact with the second point of contact 22, has only been deformed to an insignificant extent in relation to the relaxed state, which is shown in FIG. 6. A larger torque than at the second point of contact 22 acts on the border strip 6 by a first point of contact 20. It is, thus, possible, by introduction of the end bar 8, for the border strip 6 to be easily bent from the position I of FIG. 6 into the position II, in which it is orthogonal to the side wall 7. The accuracy by which it is possible to produce the orthogonal state between the border strip 6 and the side wall 7 is predetermined precisely by the tolerance with which the end section 16 is formed.

Figure 8:
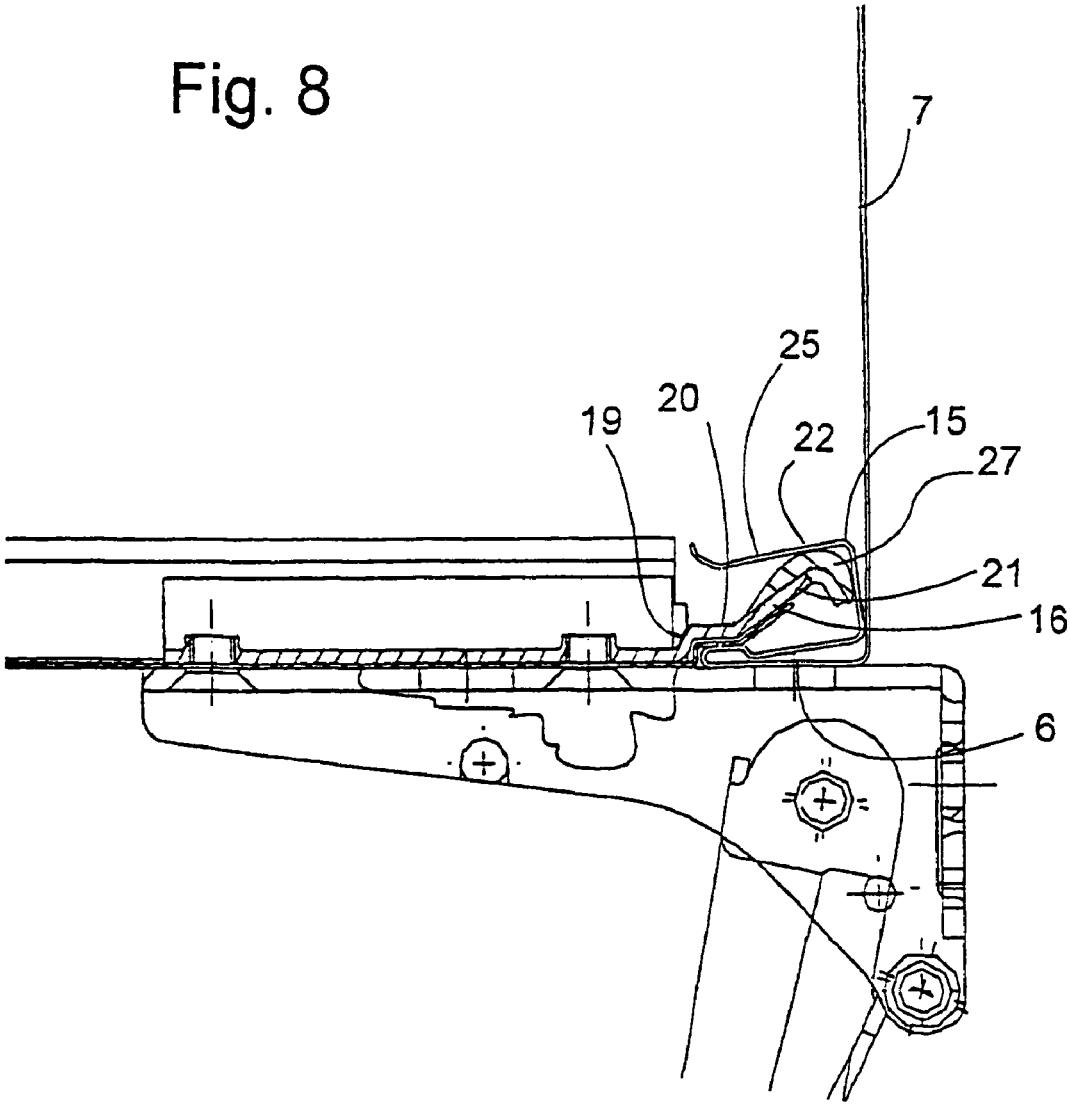
FIG. 8 is a fragmentary, horizontal, cross-sectional view of an alternative embodiment of the cross-section of FIG. 4.

FIG. 8 shows a modified configuration of the end bar 8 in engagement with a clamp 15 of a side part. The side part is identical to that shown in FIG. 4. The end section 16 of the end bar bears a plastic buffer body 27, which forms the second point of contact 22. The buffer body 27 can be flexibly deformed to a slight extent under the pressure acting on the second point of contact 22, and, thus, makes it easier to align the border strip 6 in its position orthogonal to the side wall 7 with increased tolerance of the dimensions of the end section 16 and of the clamp 15 and of the bending strength of the clamp 15. Using buffer bodies of different thicknesses, furthermore, allows convenient adaptation if use is made, for producing the side parts, of batches of sheet metals with varying bending strength.

The same successful result may, of course, also be achieved if the buffer body 27 is replaced by a buffer body that is borne by the leg 25 of the clamp.

I claim:

1. A housing for a refrigerator, comprising:

a body defining an interior and having;

at least one side part formed from a panel of flat material; side walls; and a front side with an opening open to said interior;

vertical border strips and horizontal end bars surrounding said opening, at least one of said border strips together with at least one of said side walls being a constituent part of said at least one side part;

said side part having a joining element for joining said side part together with at least one of said end bars; and said at least one end bar being introduced into said joining element, and subjecting said border strip to a force having an effect of widening an angle at which said border strip is connected to said side wall, said at least one end bar has a front side and a rear side, said joining element forms a clamp clamping in said at least one end bar between at least two points of contact on a respective one of said front and rear sides, said two points of contact each being spaced apart by different distances from a side wall of said body, and said at least one end bar has a joint-on buffer body forming at least one of said points of contact.

2. The housing according to claim 1, wherein said point of contact on said rear side of said at least one end bar is located closer to an adjacent one of said side walls than said point of contact on said front side of said at least one end bar.

3. The housing according to claim 1, wherein:

said at least one end bar has a section with a thickness;

said clamp has two opposite legs defining a U-profile and a groove;

a distance between said two opposite legs is greater than said thickness of said section of said at least one end bar; and said section engages in said clamp and extends obliquely through said groove of said U-profile between said two points of contact.

4. The housing according to claim 1, wherein:

at least one of said border strips has an edge directed away from said side wall; and said joining elements is connected integrally to said edge directed away from said side wall.

5. The housing according to claim 1, wherein said joining element is connected elastically to said border strip.

6. The housing according to claim 1, wherein said joining element is connected rigidly to said border strip.

7. The housing according to claim 1, wherein said joining element is connected rigidly to side wall.

8. The housing according to claim 1, wherein said joining element is connected rigidly to one of the group consisting of said border strip and a side wall of said border strip.

9. The housing according to claim 1, wherein said border strip is covered with a colored sheet material.

10. The housing according to claim 1, wherein said side wall is free of a color coating at least in a rear region thereof.

11. A housing for a refrigerator, comprising:

a body defining an interior and having;

at least one side part formed from a panel of flat material; side walls; and a front side with an opening open to said interior;

vertical border strips and horizontal end bars surrounding said opening, at least one of said border strips together with at least one of said side walls being a constituent part of said at least one side part;

said side part having a joining element for joining said side part together with at least one of said end bars; and said at least one end bar being introduced into said joining element, and subjecting said border strip to a force having an effect of widening an angle at which said border strip is connected to said side wall, said joining element is connected elastically to said border strip and said joining element is retained by said at least one end bar in a position in which said joining element has been rotated elastically in relation to a position that said joining element assumes when not joined together with said at least one end bar.

* * * * *